US007401449B2

(12) United States Patent
Watson et al.

(10) Patent No.: US 7,401,449 B2
(45) Date of Patent: Jul. 22, 2008

(54) APPARATUS AND METHOD FOR DISPENSING STRETCH WRAP

(76) Inventors: Randy Thomas Watson, 122 Hunterbrook Place NW, Calgary, Alberta (CA) T2K 4V7; Steve Tom Garneau, 122 Hunterbrook Place NW, Calgary, Alberta (CA) T2K 4V7; Cliff Raymond Baril, Box 14, site 6, RR #6, Conrich, Alberta (CA) T2M 4L5

( * ) Notice: Subject to any disclaimer, the term of this patent is extended or adjusted under 35 U.S.C. 154(b) by 0 days.

(21) Appl. No.: 11/510,214

(22) Filed: Aug. 28, 2006

(65) Prior Publication Data

US 2008/0072543 A1 Mar. 27, 2008

(51) Int. Cl.
*B65B 67/08* (2006.01)

(52) U.S. Cl. ..... 53/399; 53/441; 53/556; 53/588; 53/592; 53/390; 242/588; 242/423

(58) Field of Classification Search ..... 53/399, 53/441, 588, 592, 390, 556, 590; 242/405, 242/405.3, 588, 588.2, 597, 423, 423.1, 423.2, 242/588.1

See application file for complete search history.

(56) References Cited

U.S. PATENT DOCUMENTS 1,226,928 A * 5/1917 Updike ..... 242/588.2
1,364,259 A * 1/1921 Eaton ..... 242/156
3,100,607 A * 8/1963 Wiggins ..... 242/423
4,102,513 A * 7/1978 Guard ..... 242/423.1
4,360,172 A * 11/1982 Cope ..... 242/592
4,522,348 A * 6/1985 Strout et al. ..... 242/422.1
4,535,951 A * 8/1985 Riemenschneider, III 242/423.2
4,706,442 A * 11/1987 Riemenschneider ..... 53/556
4,714,211 A * 12/1987 Hwang ..... 242/423.1
5,868,334 A * 2/1999 Cedillo ..... 242/405.3
6,241,176 B1 * 6/2001 McEntee ..... 242/405.3
6,425,614 B1 * 7/2002 Limber et al. ..... 294/24
6,564,532 B2 * 5/2003 Gutche ..... 53/556
6,739,542 B1 * 5/2004 Prina et al. ..... 242/423.2

(Continued)

*Primary Examiner*—Stephen F Gerrity
(74) *Attorney, Agent, or Firm*—Red Gallagher

(57) ABSTRACT

An apparatus for covering goods, and goods stacked on a pallet with plastic wrap supplied in a roll comprises: a) a roll head adapted to rotatably carry the roll of plastic wrap, the roll head having a friction mechanism so that ease of rotation of the roll with respect to the head is controlled thereby facilitating stretching the wrap around the goods after an end portion of the wrap is initially secured adjacent to the goods; and, b) an elongate handle portion carrying the roll head and extending therefrom in a direction generally parallel to the axis of the roll of plastic wrap. A method of wrapping goods stacked on a pallet with plastic wrap supplied in a roll comprising the steps of: a) elevating the pallet and the goods stacked thereon so that there is sufficient clearance to readily pass the roll of plastic wrap beneath the pallet; b) providing a wrap apparatus as defined above; c) loading the roll head of the apparatus with a roll of plastic wrap; d) attaching an end portion of the plastic wrap to one of the pallet and the goods stacked thereon; and then, e) with the user standing adjacent to the elevated pallet having the goods stacked thereon, encircling the pallet and goods thereon with the roll head, by generally moving the handle in an outline of a cone, thereby encircling and securing the goods and pallet together with plastic wrap.

13 Claims, 1 Drawing Sheet

U.S. PATENT DOCUMENTS 6,883,292 B1 * 4/2005 Chen ..... 53/389.1
6,883,298 B2 * 4/2005 Gooding et al. ..... 53/592
6,920,742 B1 * 7/2005 Yu Chen ..... 53/592
2007/0151208 A1 * 7/2007 Huang ..... 53/390

* cited by examiner

APPARATUS AND METHOD FOR DISPENSING STRETCH WRAP

FIELD OF THE INVENTION

This invention relates to dispensing and applying shrink wrap or stretch film from a roll to around a product, or to around a product and a pallet carrying the product. More particularly this invention relates to a roll dispensing apparatus having a roll center portion which is axially attached to a pole so that the stretch film can be positioned around the bottom portion of the product which may be carried on the pallet without requiring the user to bend over; as well as allowing the user to "belly wrap" the product on the pallet thereby facilitating cinching any irregularly shaped and over or under sized product securely to the pallet, relatively quickly and again while standing and without bending over or kneeling.

BACKGROUND OF THE INVENTION

Shrink wrap, stretch film, or cellophane, of approximately one foot in width, is most commonly used to secure packaged product together, and to maintain that product carried on a pallet. Product stretch wrapped onto a pallet is better protected from being torn or otherwise damaged during transit. Product so wrapped on the pallet is so sufficiently attached to the pallet that straps are not required to maintain the product in position thereon. Products which are irregularly shaped or either substantially larger or smaller than the pallet can be quickly and securely attached to the pallet.

Particularly with products which are irregularly shaped or are substantially larger or smaller than the pallet it is advantageous to "belly wrap" these products to the pallet. Belly wrapping products better secures them to the pallet. Typically the pallet is lifted by a fork lift and wrap is positioned under the pallet and over and around the product on the pallet. Occupational Health and Safety Regulations prohibit individuals from positioning themselves even temporarily under temporarily raised items. It is difficult, if not impossible to belly wrap product on a pallet with currently available wrap dispensers without passing the applicator and one's body underneath the elevated pallet. There is a need for a wrap dispenser which facilitates quickly and safely belly wrapping a product on a pallet. There is also a need for a wrap dispenser which enables one to laterally wrap a product stacked on a pallet to the pallet without bending over.

OBJECTS OF THE INVENTION

It is an object of this invention to disclose a wrap dispensing apparatus which facilitates belly wrapping product on a pallet without bending over and without even temporarily positioning oneself beneath the suspended product on the pallet. It is an object of this invention to disclose an effective method of belly wrapping a product to a pallet thereby stabilizing the load, and minimizing the risk of losing control of the load during handling. It is an object of this invention to disclose a wrap dispensing apparatus which allows one to belly wrap a product on a pallet substantially more quickly than with any wrap dispenser presently available. It is yet a further object of this invention to disclose a wrap dispensing apparatus which allows one to more quickly and without bending over laterally wrap and attach a product on and to a pallet.

One aspect of this invention provides for an apparatus for covering goods, and goods stacked on a pallet with plastic wrap supplied in a roll comprises: a) a roll head adapted to rotatably carry the roll of plastic wrap, said roll head having a friction mechanism so that ease of rotation of the roll with respect to the head is controlled thereby facilitating stretching the wrap around the goods after an end portion of the wrap is initially secured adjacent to the goods; and, b) an elongate handle portion carrying the roll head and extending therefrom in a direction generally parallel to the axis of the roll of plastic wrap. Then when the goods on the pallet are elevated the user can stand adjacent to the goods and move the roll head under, over, and around the goods encircling and securing the goods and pallet together with plastic wrap.

In a preferred aspect of this invention a method of wrapping goods stacked on a pallet with plastic wrap supplied in a roll comprising the steps of: a) elevating the pallet and the goods stacked thereon so that there is sufficient clearance to readily pass the roll of plastic wrap beneath the pallet; b) providing a wrap apparatus as defined above; c) loading the roll head of the apparatus with a roll of plastic wrap; d) attaching an end portion of the plastic wrap to one of the pallet and the goods stacked thereon; and then, e) with said user standing adjacent to the elevated pallet having said goods stacked thereon, encircling the pallet and goods thereon with the roll head, by generally moving the handle in an outline of a cone, thereby encircling and securing the goods and pallet together with plastic wrap.

Various other objects, advantages and features of this invention will become apparent to those skilled in the art from the following description in conjunction with the accompanying drawings.

FIGURES OF THE INVENTION

Figure 1:
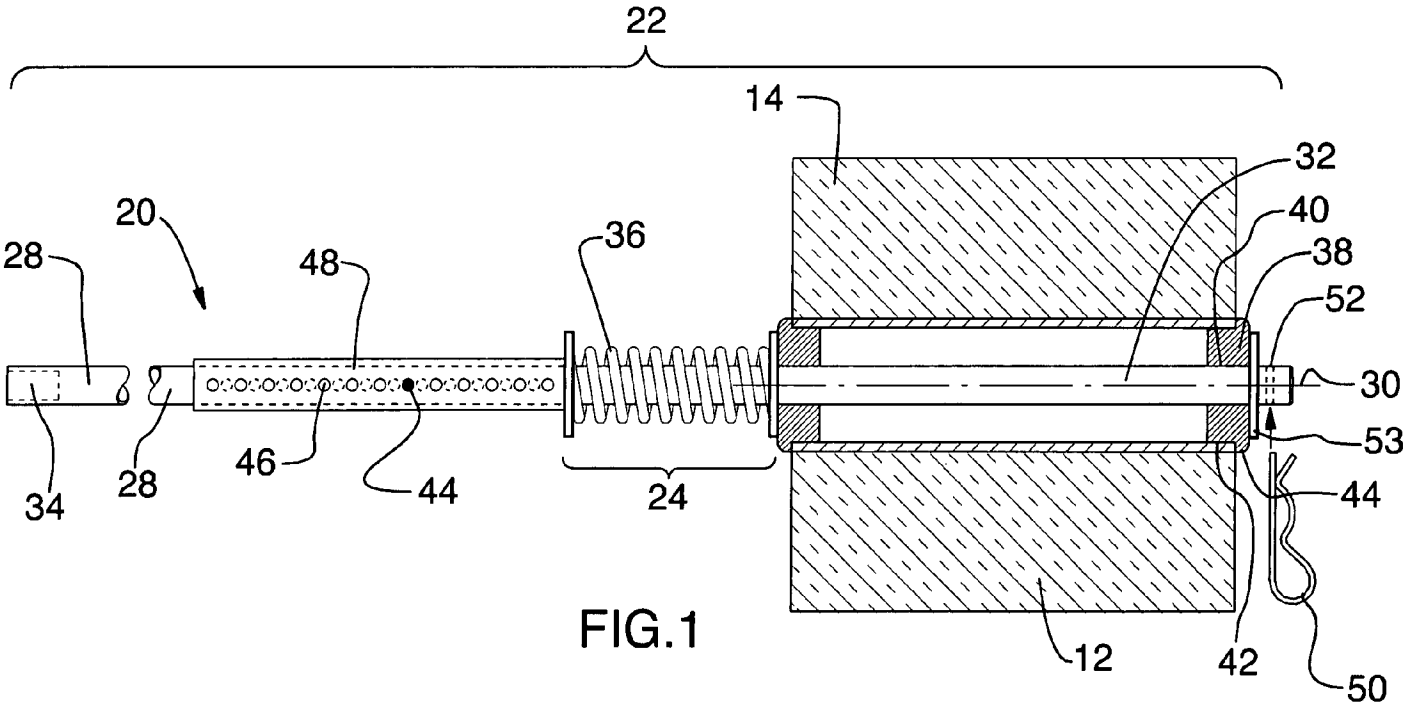
FIG. 1 is a cross sectional view of a wrap dispensing apparatus.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 3:
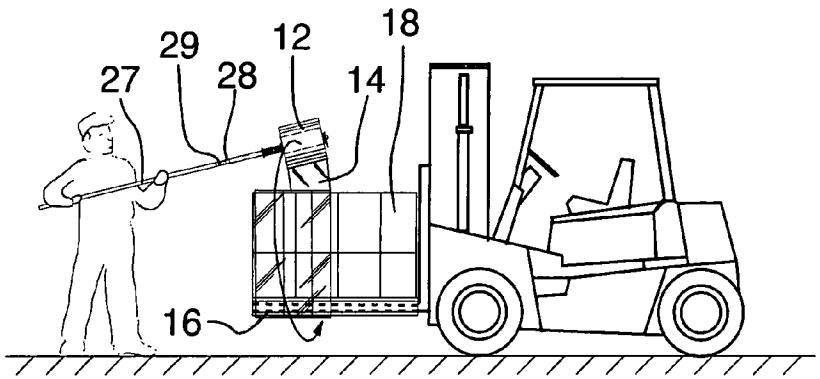
FIG. 3 is an elevational view of a user wrapping goods stacked on a pallet held in an elevated position by a fork lift.

Turning now to the drawings and more particularly to FIG. 1 we have a cross sectional view of a wrap dispensing apparatus 20. Most generally an apparatus 20 for covering goods 18, and goods 18 stacked on a pallet 16 with plastic wrap 14 (see goods 18 and pallet 16 on FIG. 3) supplied in a roll 12 comprises: a) a roll head 22 adapted to rotatably carry the roll 12 of plastic wrap 14, said roll head 22 having a friction mechanism 24 so that ease of rotation of the roll 12 with respect to the head 22 is controlled thereby facilitating stretching the wrap 14 around the goods 18 after an end portion of the wrap 14 is initially secured adjacent to the goods 18; and, b) an elongate handle portion 26 carrying the roll head 22 and extending therefrom in a direction generally parallel to the axis 30 of the roll 12 of plastic wrap 14. Then when the goods 18 on the pallet 16 are elevated the user can stand adjacent to the goods 18 and move the roll head 22 under, over, and around the goods 18 encircling and securing the goods 18 and pallet 16 together with plastic wrap 14.

Most preferably the elongate handle portion 28 extends from the roll head 22 in a line generally coincident with an axis 30 of the roll 12 of plastic wrap 14, and wherein the roll head 22 comprises a roll axle 32 which extends through said roll 12 wholly carrying said roll 12 therewith, without utilizing an arm (not shown) extending externally around the roll 12 so that said head 22 may be moved fully around goods 18 without rotation of the handle portion 26, and without the plastic wrap 14 being obstructed by the omitted arm (not shown) extending externally around the roll 12. In the most preferred embodiment of the invention the elongate handle portion 28 and the roll axle 32 comprise a singular tubular shaft 28.

The invention has been constructed wherein the tubular shaft 28 has a length between 4 and 7 feet—more precisely 6 foot 4 inches, and wherein an unattached end portion of the handle portion 26 is weighted 34 to counter balance the weight of the roll head 22 carrying the roll 12 of plastic wrap 14.

Figure 2:
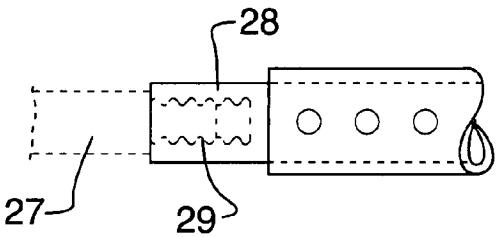
FIG. 2 is a partial view of a trunated tubular shaft having an internal thread for reception of a telescoping handle of the type used on a paint roller frame.

FIG. 2 is a partial view of a trunated tubular shaft 28 having an internal thread 29 for reception of a telescoping handle 27 of the type used on a paint roller frame. (not shown) In an alternative embodiment of the invention wherein the tubular shaft 28 is truncated and the truncated end portion terminates in an internal thread 29 sized to receive a telescoping handle 27 of the type used on a paint roller frame. (not shown)

In the most preferred embodiment of the invention the friction mechanism 24 comprises a cylindrical compression spring 36 positioned over the shaft 28 to axially squeeze the roll 12 of the wrap 14 longitudinally along the roll axle 32 so that tension may be maintained in the plastic wrap 14 as it is unwound and pulled around the goods 18. Most preferably there are two plastic inserts 38 each which have a centered axle hole 40 therethrough, and have an intermediate diameter 42 sized to be closely received within the roll 12 of plastic wrap 14, and have an outer diameter 44 incrementally larger than the intermediate diameter to diametrically engage opposite ends of a center tube 46 of the roll 12 of plastic wrap 14 so that the roll 12 is held centered about the axle 32 and can be squeezed therebetween the plastic inserts 38.

In the most preferred embodiment of the invention the spring's 36 compression, and accordingly the wrap 14 tension, may be set, by maintaining the spring 36 in a position of selected compression with a push button 44 extending through a push button reception hole 46 in a sleeve 48 which slides over the shaft 28. Most preferably there are multiple push button reception holes 46 incrementally spaced along the sleeve 48 so that the force applied by the spring 36 and transmitted to the roll 12, can be selected by choosing a selected push button reception hole 46 at a selected distance along the sleeve 48. In the most preferred embodiment of the invention there are two rows of diametrically opposite aligned holes 46 along the sleeve 48, and wherein the aligned holes on one side of the sleeve 48 are incrementally advanced relative to those aligned holes on the other opposite side of the sleeve 48 so that spring 36 force can be incrementally increased or decreased.

In the most preferred embodiment of the invention an outer end of the roll 12 is maintained on an outer end of the axle 32 by a hitch pin clip 50 extending through a diametric hole 52 through the shaft 28 which comprises an axle 32 against a flat washer 53 and wherein an inner end of the roll 12 is biased outwardly by the spring 36 positioned between two flat washers 53, and wherein the inner end of the spring 36 is held at a selected distance from the outer end of the axle 32 by the sleeve 48 which is adjustably held along the axle 32 by the push button 44 extending through one of the push button reception holes 46 therealong; so that the apparatus 20 can accept rolls 12 of varying lengths and the roll friction can be varied for a roll 12 of a given length by selecting an appropriate push button reception hole 46.

In the most preferred embodiment of the invention an outer end of the roll 12 is maintained on an outer end of the axle 32 by a hitch pin clip 50 extending through a diametric hole 52 through the axle 32 against a flat washer 53 and wherein an inner end of the roll 12 is biased outwardly by the spring 36 positioned between two flat washers 53, and wherein the inner end of the spring 36 is held at a selected distance from the outer end of the axle 32 by the sleeve 48 which is adjustably held along the axle 32 by the push button 44 extending through one of the push button reception holes 46 therealong; so that the apparatus 20 can accept rolls 12 of varying lengths and the roll friction can be varied for a roll 12 of a given length by selecting an appropriate push button reception hole 46.

A method of wrapping goods 18 stacked on a pallet 16 with plastic wrap 14 supplied in a roll 12 comprises the steps of: a) elevating the pallet 18 and the goods 16 stacked thereon so that there is sufficient clearance to readily pass the roll 12 of plastic wrap 14 beneath the pallet 16; b) providing a wrap apparatus 20 as defined most generally described above; c) loading the roll head 22 of the apparatus 20 with a roll 12 of plastic wrap 14; d) attaching an end portion of the plastic wrap 14 to one of the pallet 16 and the goods 18 stacked thereon; and then, e) with said user standing adjacent to the elevated pallet 16 having said goods 18 stacked thereon, encircling the pallet 16 and goods 18 thereon with the roll head 22, by generally moving the handle 28 in an outline of a cone, thereby encircling and securing the goods 18 and pallet 16 together with plastic wrap 14. The method may be similarly undertaken wherein the apparatus 20 used is as most generally described above.

While the invention has been described with preferred specific embodiments thereof, it will be understood that this description is intended to illustrate and not to limit the scope of the invention, which is defined by the following claims.

We claim:

1. An apparatus for covering goods, and goods stacked on a pallet with plastic wrap supplied in a roll comprising:

a) a roll head adapted to rotatably carry the roll of plastic wrap, said roll head positioned on a shaft and having a cylindrical spring positioned over the shaft to axially squeeze the roll of the wrap on the roll center so that tension may be maintained in the plastic wrap as it is unwound and pulled around the goods thereby providing a friction mechanism to facilitate stretching the wrap around the goods after an end portion of the wrap is initially secured adjacent to the goods; and, b) an elongate handle portion carrying the roll head and extending therefrom in a direction generally parallel to the axis of the roll of plastic wrap wherein the elongate handle portion extends from the roll head in a line generally coincident with an axis of the roll of plastic wrap, and wherein the roll head comprises a central support portion which extends through said roll wholly carrying said roll therewith, without utilizing an arm extending externally around the roll so that said head may be moved fully around the goods without rotation of the handle portion and without the plastic wrap being obstructed by the omitted arm extending externally around the roll;

c) two plastic inserts each which has a centered shaft hole therethrough, and have an intermediate diameter sized to be closely received within the roll of plastic wrap, and have an outer diameter incrementally larger than the intermediate diameter to diametrically engage opposite ends of a center tube of the roll of plastic wrap so that the roll of plastic wrap is held centered about the shaft and can be squeezed therebetween;

d) a push button extending through a push button reception hole in a sleeve which slides over the shaft to vary the spring compression, and accordingly the wrap tension, by maintaining the spring in a position of selected compression;

so that when the goods on the pallet are elevated the user can stand adjacent to the goods and move the roll head under, over, and around the goods encircling and securing the goods and pallet together with plastic wrap.

2. An apparatus as in claim 1 wherein there are multiple push button reception holes incrementally spaced along the sleeve so that the squeeze applied on the spring and transmitted to the roll can be selected by choosing a selected push button reception hole at a selected distance along the sleeve.

3. An apparatus as in claim 2 wherein there are two rows of diametrically opposite aligned holes along the sleeve, and wherein the aligned holes on one side of the sleeve are incrementally advanced relative to those aligned holes on the other opposite side of the sleeve so that spring force can be incrementally increased or decreased.

4. An apparatus as in claim 3 wherein an outer end of the roll is maintained on an outer end of the shaft by a hitch pin clip pin extending through a diametric hole through the shaft against a flat washer and wherein an inner end of the roll is biased outwardly by the spring positioned between two flat washers, and wherein the inner end of the spring is held at a selected distance from the outer end of the shaft by the sleeve which is adjustably held along the shaft by the push button extending through one of the push button reception holes therealong; so that the apparatus can accept rolls of varying lengths and the roll friction can be varied for a roll of a given length by selecting an appropriate push button reception hole.

5. A method of wrapping goods stacked on a pallet with plastic wrap supplied in a roll comprising the steps of:

a) elevating the pallet and the goods stacked thereon so that there is sufficient clearance to readily pass the roll of plastic wrap beneath the pallet;

b) providing a wrap apparatus having i) a roll head adapted to rotatably carry the roll of plastic wrap, said roll head having a friction mechanism so that ease of rotation of the roll with respect to the head is controlled thereby facilitating stretching the wrap around the goods after an end portion of the wrap is initially secured adjacent to the goods; and, ii) an elongate handle portion carrying the roll head and extending therefrom in a direction generally parallel to the axis of the roll of plastic wrap;

so that when the goods on the pallet are elevated the user can stand adjacent to the goods and move the roll head under, over, and around the goods encircling and securing the goods and pallet together with plastic wrap;

c) loading the roll head of the apparatus with a roll of plastic wrap;

d) attaching an end portion of the plastic wrap to one of the pallet and the goods stacked thereon; and then, e) with said user standing adjacent to the elevated pallet having said goods stacked thereon, encircling the pallet and goods thereon with the roll head, by generally moving the handle in an outline of a cone, thereby encircling and securing the goods and pallet together with plastic wrap.

6. A method as in claim 5 wherein the wrap apparatus has an elongate handle portion which extends from the roll head in a line generally coincident with an axis of the roll of plastic wrap, and wherein the roll head comprises a central support portion which extends through said roll wholly carrying said roll therewith, without utilizing an arm extending externally around the roll so that said head may be moved fully around the goods without rotation of the handle portion, and without the plastic wrap being obstructed by the omitted arm extending externally around the roll.

7. A method as in claim 6 wherein the elongate handle portion and the central support portion of the wrap apparatus comprise a singular tubular shaft.

8. A method as in claim 7 wherein the friction mechanism of the wrap apparatus comprises a cylindrical spring positioned over the shaft to axially squeeze the roll of the wrap on the roll center so that tension may be maintained in the plastic wrap as it is unwound and pulled around the goods.

9. A method as in claim 8 wherein the wrap apparatus further comprises two plastic inserts each which has a centered shaft hole therethrough, and have an intermediate diameter sized to be closely received within the roll of plastic wrap, and have an outer diameter incrementally larger than the intermediate diameter to diametrically engage opposite ends of a center tube of the roll of plastic wrap so that the roll of plastic wrap is held centered about the shaft and can be squeezed therebetween.

10. A method as in claim 9 wherein the spring compression, and accordingly the wrap tension, of the wrap apparatus may be maintained by maintaining the spring in a position of selected compression with a push button extending through a push button reception hole in a sleeve which slides over the shaft.

11. A method as in claim 10 wherein there are multiple push button reception holes incrementally spaced along the sleeve of the wrap apparatus so that the squeeze applied on the spring and transmitted to the roll can be selected by choosing a selected push button reception hole at a selected distance along the sleeve.

12. A method as in claim 11 wherein there are two rows of diametrically opposite aligned holes along the sleeve of the wrap apparatus, and wherein the aligned holes on one side of the sleeve are incrementally advanced relative to those aligned holes on the other opposite side of the sleeve so that spring force can be incrementally increased or decreased.

13. A method as in claim 12 wherein an outer end of the roll of the wrap apparatus is maintained on an outer end of the shaft by a hitch pin clip pin extending through a diametric hole through the shaft against a flat washer and wherein an inner end of the roll is biased outwardly by the spring positioned between two flat washers, and wherein the inner end of the spring is held at a selected distance from the outer end of the shaft by the sleeve which is adjustably held along the shaft by the push button extending through one of the push button reception holes therealong; so that the apparatus can accept rolls of varying lengths and the roll friction can be varied for a roll of a given length by selecting an appropriate push button reception hole.

* * * * *